US008037612B2

(12) United States Patent
Hansen et al.

(10) Patent No.: US 8,037,612 B2
(45) Date of Patent: Oct. 18, 2011

(54) HANDHELD TACTICAL KNIFE

(76) Inventors: Jeremiah Hansen, Spotsylvania, VA (US); Thomas Della-Penna, Spotsylvania, VA (US)

( * ) Notice: Subject to any disclaimer, the term of this patent is extended or adjusted under 35 U.S.C. 154(b) by 330 days.

(21) Appl. No.: 12/258,467

(22) Filed: Oct. 27, 2008

(65) Prior Publication Data

US 2010/0101100 A1 Apr. 29, 2010

(51) Int. Cl.
*B26B 9/02* (2006.01)
*B26B 3/00* (2006.01)

(52) U.S. Cl. ..... 30/335; 30/165; 30/357

(58) Field of Classification Search ..... 30/335, 30/165, 357, 47.2, 346, 355; 463/47.4, 471–47.7; 294/61, 74; 135/65, 66, 81; 434/247, 11; D22/117, 118; D8/DIG. 1; D3/5–17
See application file for complete search history.

(56) References Cited

U.S. PATENT DOCUMENTS

| | | | | | |
|---|---|---|---|---|---|
| 436,891 | A | | 9/1890 | Deunerlohr | |
| 822,456 | A | | 6/1906 | Jones | |
| D137,916 | S | | 5/1944 | Mrazek | |
| 2,566,112 | A | | 8/1951 | Barnard | |
| 2,630,314 | A | * | 3/1953 | Cadwallader | 177/129 |
| 2,631,366 | A | | 3/1953 | Anderson | |
| 3,035,344 | A | * | 5/1962 | Brown | 30/115 |
| D220,930 | S | | 6/1971 | Arlett | |
| 3,888,005 | A | * | 6/1975 | Bagwell | 30/286 |
| 4,198,751 | A | * | 4/1980 | Egbert | 30/286 |
| 4,495,698 | A | | 1/1985 | Gerber, Jr. | |
| 4,870,757 | A | * | 10/1989 | Kirkpatrick et al. | 30/344 |
| 5,322,277 | A | | 6/1994 | Paul et al. | |
| D392,016 | S | * | 3/1998 | Balolia | D22/118 |
| 6,044,566 | A | * | 4/2000 | Ries et al. | 30/345 |
| D451,571 | S | * | 12/2001 | Barker, II | D22/118 |
| D473,923 | S | * | 4/2003 | Rae | D22/118 |
| D482,426 | S | | 11/2003 | Taylor | |
| 6,837,896 | B2 | | 1/2005 | Matsutani | |
| 7,228,633 | B2 | | 6/2007 | Ryan | |
| D559,939 | S | * | 1/2008 | Veff, III | D22/118 |
| 2005/0188549 | A1 | * | 9/2005 | Ryan | 30/353 |

OTHER PUBLICATIONS

Catalog listing: Military Thrust Dagger, listed in "Cheaper Than Dirt" website (http://www.cheaperthandirt.com/DBA101-1.html) Page accessed Oct. 25, 2008.
Catalog listing: Ninja Throwing Spike, listed in "Karate Depot" website (http://www.karatedepot.com/wp-ni-51.html), Page accessed Oct. 25, 2008.

* cited by examiner

*Primary Examiner* — Ghassem Alie
(74) *Attorney, Agent, or Firm* — Maier & Maier, PLLC

(57) ABSTRACT

A handheld tactical knife comprising a hilt and an elongated knife blade with a substantially triangular cross section. A spine runs on the top of said elongated knife blade, and tapers from the hilt to a tip of the blade. A main cutting edge is located on the bottom of said elongated knife blade, and at least one scallop is cut into the main cutting edge. At least one scallop transitions into a gut hook with a gut hook tip, and a flat spreading surface is located between the gut hook tip and the tip of the blade. The substantially triangular cross section of the elongated knife blade transitions to a substantially trapezoidal cross section at the flat spreading surface.

5 Claims, 3 Drawing Sheets

HANDHELD TACTICAL KNIFE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to knives, specifically to tactical knives for hand-to-hand combat.

2. Prior Art

Prior art U.S. Pat. Nos. 7,228,633; 6,837,896; 5,322,277; 436,891; 822,456; 2,631,366; 2,566,112; 4,495,698; D220,930; D137,916; D482,426

Tactical knives vary in layout and usually consist of a flat blade with one to both edges sharpened for an effective cutting edge. Some examples of this type can be seen in U.S. Pat. Nos. D482,426; D137,916; and D220,930. The straight edge on these knives makes an effective cutting and slashing tool, but lacks penetration power due to the wide profile. This constant profile also can limit knife removal due to suction within the wound. These knives are limited in their capacity to do additional damage that is more difficult to repair, such as tears, because of the sharpened edges. The addition of serrations, while making the wound more grievous, might cause the knife to become caught in the wound, clothing, or armor. The flat bladed knives also can bend and break if the force is sufficient perpendicular to the edge, limiting their durability.

Other weapons exist which penetrate well that are essentially long spikes, such as ice picks, spike bayonets, and some "throwing spikes." However, this variety of weapon lacks an effective cutting surface and contains a consistent cross section. This cross section subjects the weapon to the same problem of suction in the wound. Some of these weapons have triangular shapes, which reduces the probability of effective wound treatment. Many of these weapons are thin and bend easily, causing damage to the weapon and complicating weapon removal, if possible at all. Spike-like weapons usually are not designed with cutting edges, preventing such weapons from being used in a cutting role. If the spike-like weapon does include an edge, the edge is usually not in a configuration to allow more utilitarian roles of cutting objects.

3.Objects and Advantages

Accordingly, several objects and advantages of the invention are the ability to penetrate well, provide more than one cutting surface, and strength in all directions to ensure the knife does not bend, buckle or break when used in a tactical hand-to-hand combat situation. The invention is based on several concepts- triangular cross section for strength, a piercing point, tapered cross section, and cutting edges. Previous knives have not combined all of these aspects into a single hand-to-hand knife. When they are combined, the result is a knife capable of piercing, cutting, and slashing while reducing the likelihood of becoming deformed or suctioned in the wound. The triangular cross section provides not only strength, but also three potential cutting surfaces. The knife tip, when placed on the solid triangular cross section, can be subjected to higher loads in piercing due to the strength of the main portion of the knife. The tip will have less ability to flex, allowing the weapon to penetrate without losing energy or directionality due to deformation.

Tip cross-section allows for effective anatomical penetration, such as the intercostal area of the ribs and the foramina at the base of the skull. A standard knife is limited in its ability to penetrate this type of area. A spike-based weapon is unable to exploit the penetration to cause further damage by rotation of the weapon.

Further objects and advantages will become apparent from a consideration of the ensuing description and drawings.

BRIEF SUMMARY OF THE INVENTION

In accordance with the invention, this present invention provides a tactical knife with an effective cutting edge, a penetrating tip, a more complex wound and a cross section optimized for strength. The knife is designed in such a way as to provide the user with an effective tool for tactical hand-to-hand combat. The knife is created to provide the user with a penetrating tool capable of exploiting small target areas for disabling or eliminating an opponent if a slicing motion is not possible. If a slicing motion is possible, an effective cutting edge is likewise available for the user.

Blade tapers prevent wound suction. The knife cross section will tend to tear and cut the material perpendicular to the penetration. The shallow gut hook allows the knife to cut tough substances without snagging. The tip will spread bone and muscle to more readily aid penetration and removal. This combination of features allows this invention to be more broadly effective than previous knives.

BRIEF DESCRIPTION OF THE SEVERAL VIEWS OF THE DRAWINGS—FIGURES

BRIEF DESCRIPTION OF THE SEVERAL VIEWS OF THE DRAWINGS—REFERENCE NUMERALS

Figure 1:
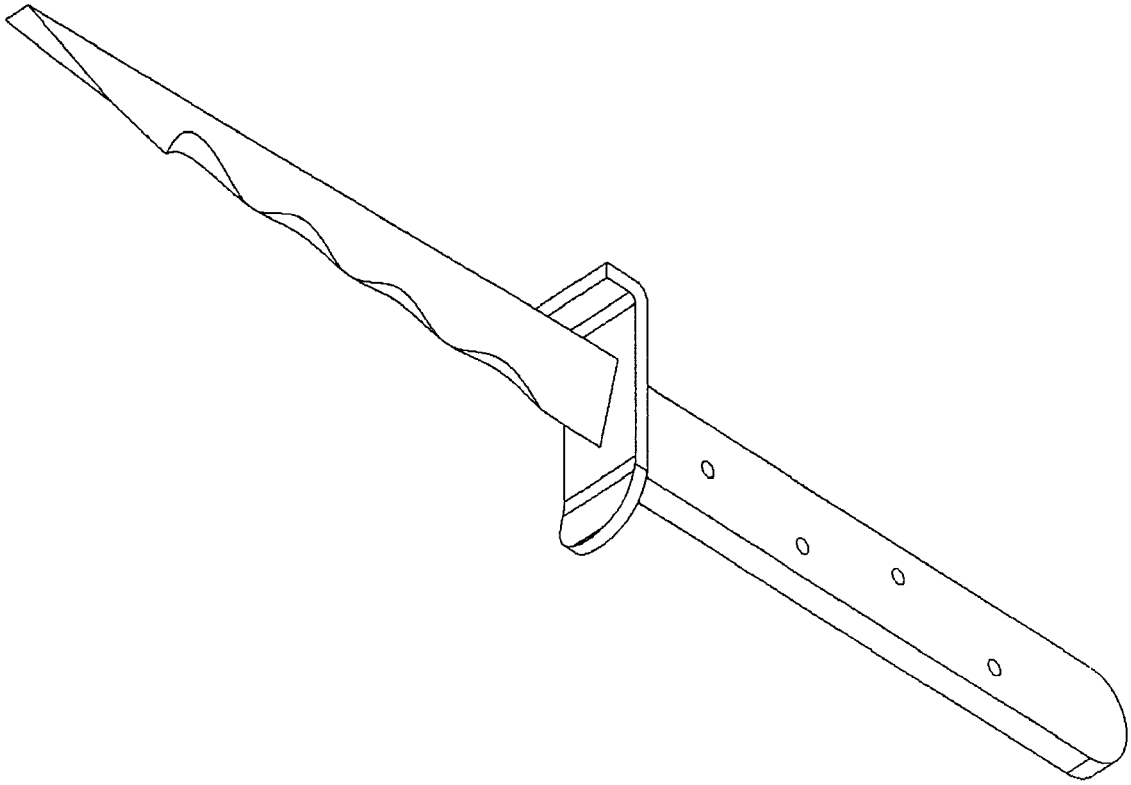
FIG. 1 is an isometric view with a view of the blade edge with a notional hilt and handle.

210 Knife Blade
212 Cutting edge
214 Scalloped edge
216 Scalloped hook
218 Cutting edge of gut hook and main point
220 Penetrating chisel tip
240 Blade spine
410 Spreading flat surface Detailed Description—Preferred Embodiment—FIGS. 1, 2, 2A, 2B, 2C, 2D, 3, 4, and 5

Figure 2:
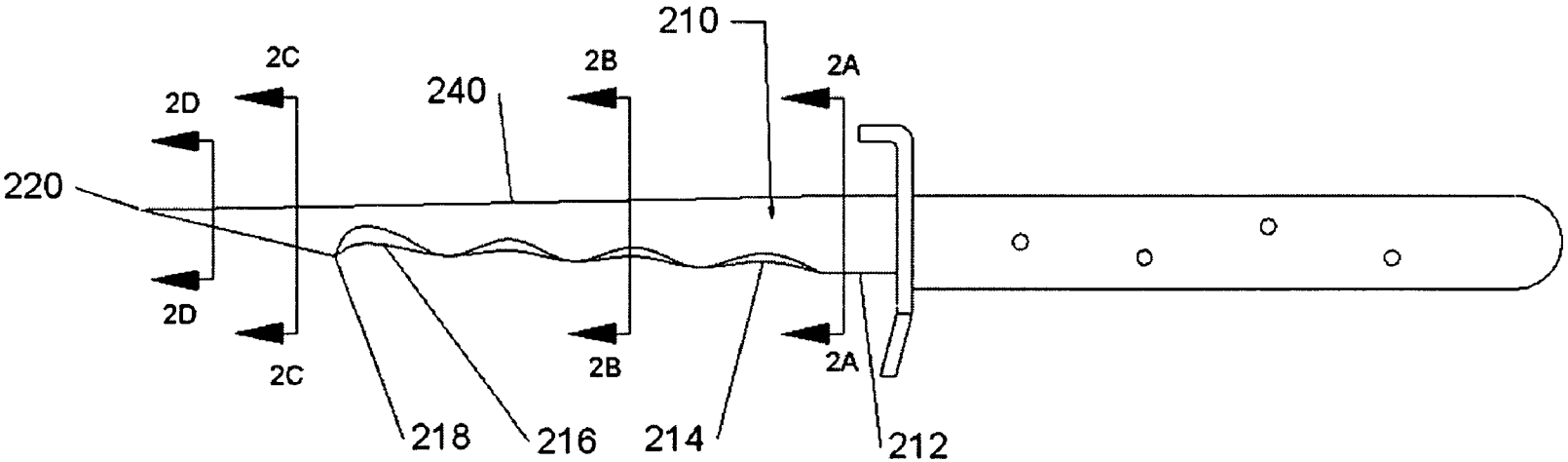
FIG. 2 is side view of the knife blade with notional hilt and handle.
Figure 2A:
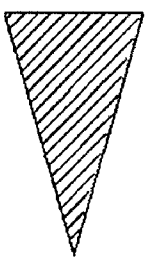
FIG. 2A is a cross sectional view of the base shape of the knife blade.
Figure 2B:
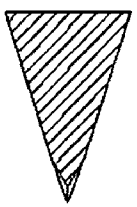
FIG. 2B is a cross sectional view at a scalloped location displaying the cut made into the base shape.
Figure 2C:
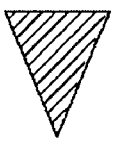
FIG. 2C is a cross sectional view between the tip and the gut hook.
Figure 2D:
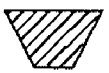
FIG. 2D is a cross sectional view of the trapezoidal cross section near the tip.
Figure 3:
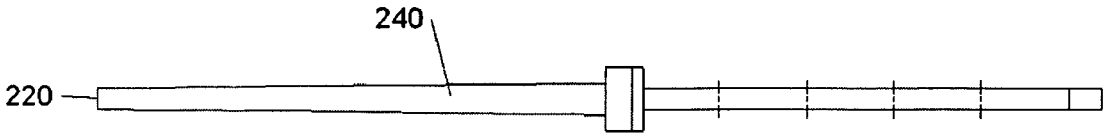
FIG. 3 is the spine view of the knife blade with notional hilt and handle.
Figure 4:
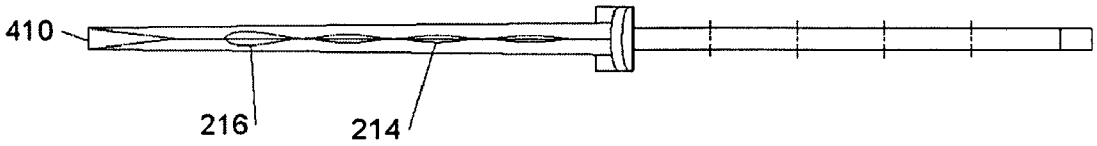
FIG. 4 is the cutting edge view of the knife blade with notional hilt and handle.

A preferred embodiment of the knife blade is shown in FIGS. 1, 2, 2A, 2B, 2C, 2D, 3, 4, and 5. A hilt and a handle are shown for illustration and orientation purposes in FIGS. 1, 2, 3, 4, and 5. FIG. 1 displays an isometric view of the preferred knife for perspective. FIG. 2 displays the side view of the knife. Knife blade 210 has an isosceles triangle cross section, shown in FIG. 2A. The preferred measurement of the cross section height from a short side to a tip is approximately 0.7 inches. In FIG. 2, the main cutting edge 212 is on the bottom of the blade. Scalloping 214 is cut into the cross section to improve cutting performance of the main blade. This cut into the cross section is displayed in FIG. 2B. Scalloping continues in a sinusoidal fashion for 3 iterations, then blends with the gut hook to create scalloped hook 216. Scalloped hook 216 transitions into the gut hook 218. From gut hook 218 to approximately one half of the remaining distance to tip 220, there is an edge. FIG. 2C displays the cross section on the tip-side of gut hook 218. The remainder of the tip has a trapezoidal cross section. FIG. 2D displays this cross section just before tip 220. FIG. 1 and FIG. 4 provide better perspective on this transition. In FIG. 2, tip 220 is in the same plane as the spine 240, which is at the top of the blade 210.

Figure 5:
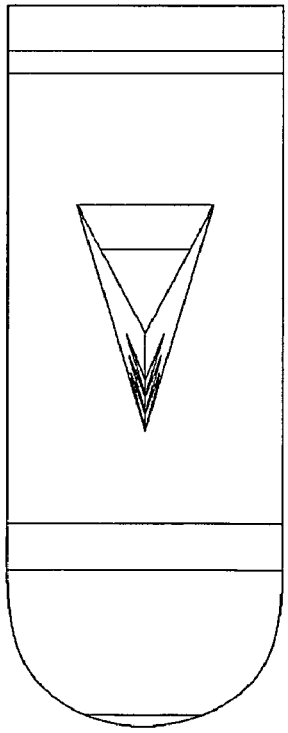
FIG. 5 is tip view of the knife blade with notional hilt and handle.

FIG. 3 illustrates the taper of spine 240 from hilt to the tip 220 from the spine view of the knife blade. In the preferred embodiment, the base spine width is approximately 0.4 inches. The preferred tip is approximately 0.25 inches. FIG. 4 illustrates the appearance of the scallop and scallop hook from the main cutting edge view. Surface, plane, or spreader 410 clearly shows where the triangular cross section transitions to a trapezoidal, shown in FIG. 2D. FIG. 5 displays the tip view of the knife blade to provide perspective on the taper along the spine and the blade height.

The preferred material for construction is carbon steel. However, the blade can consist of any knife-grade steel, alloy, ceramic, plastic material, composite, or any new material sufficiently strong to make a knife blade.

Operation—Preferred Embodiment—FIGS. 1, 2, 3, 4, 5

The operation of the preferred knife is similar to other previously mentioned knife types. Tip 220 is aligned to spine 240 to provide a cutting surface to penetrate a target. Surface 410 spreads the object being penetrated perpendicular to the cutting tip. Tapers in the blade spread the target material in three directions perpendicular to the tip penetration motion. This enables the formation and propagation of tears and cuts at the corner edges of the blade cross section. Tapers also allow air and liquids to pass into the cavity created by the blade when the blade is withdrawn from the target.

Edge 212 allows the user to cut objects in a normal manner. Scallops 214 allow the knife to slice through an object with an effectively longer edge, better separation of the material, and reduced force compared to a normal straight blade. Gut hook 216 allows the knife to be used to draw tough material together, such as sinew, into a group with a small, tight cross section, enhancing the cutting power. Gut hook tip 218 prevents the knife from catching in material while still providing a sharp tip-side edge. Edges on each longitudinal side of the spine can also be used for cutting if a completely straight edge is needed.

Description—Alternative Embodiment—FIGS. 2, 4

There are various possibilities with regard to the configuration of the knife. Scallops 214 might be omitted to provide a single, straight edge to the gut hook 216. Gut hook 216 might also be omitted to create a straight edge from a hilt to a tip. Tip may be modified to omit the tip edge 220 and flat surface 410 to draw the spine and cutting edge to a point. Addition of grooves and serrations, while not preferred, are also possible. The blade cross section can be modified to appear more as a raindrop or other cross section allowing for multi-axis strength and a cutting edge.

Coating the knife blade with protectants, colorants, friction-reducing coatings, or some combination, is possible. The knife blade material can be made from materials not suitable for knife making for the purposes of display, disposability or limited use. The knife blade may also be mounted on another object, such as a rifle, as an integral or removable piece.

Operation Alternative Embodiment

The operations of the alternative embodiments do not alter the primary functions of the knife. If a knife is made for presentation and display, it can be mounted and rendered useless for combat purposes. The knife can be rotated along the axis of the blade and the spine used as a blunt surface to strike an object without piercing or cutting. The knife may be used as a pry, relying on blade strength instead of a cutting edge. As a utility knife it will pierce cans and sheet metal.

Conclusion, Ramifications, and Scope

Accordingly the reader will see that the knife of the invention enables the user to puncture, tear and cut without concern for damage to the knife, wound suction, or the knife becoming snagged.

While the above description contains many specificities, these should not be construed as limitations on the scope of the invention, but as exemplifications of the presently preferred embodiments thereof. Many other ramifications and variations are possible within the teachings of the invention. For example, the spine edges rounded, the blade made longer or shorter in relation to the cross section, and materials might also be substituted, such as certain plastics, ceramics, and alloys that are suitable for a knife blade, as determined by one skilled in the art.

Thus the scope of the invention should be determined by the appended claims and their legal equivalents. It is not desired to be limited to the exact details of construction shown and described for obvious modifications will occur to a person skilled in the art, without departing from the spirit and scope of the appended claims.

Invention claimed is:

1. A handheld tactical knife comprising:

a hilt;

an elongated knife blade with a substantially triangular cross section;

a flat spine on a top of said elongated knife blade, said spine tapers from said hilt to a tip of said elongated knife blade, wherein the tip of the knife blade has an end edge that is perpendicular to a longitudinal axis of the knife blade;

a main cutting edge on a bottom of said elongated knife blade;

at least one scallop cut into said substantially triangular cross section along said main cutting edge, said at least one scallop transitioning into a gut hook;

a gut hook tip on said gut hook; and a flat spreading surface between said gut hook tip and the end edge of the tip of the knife blade, wherein the substantially triangular cross section of said elongated knife blade transitions to a substantially trapezoidal cross section at the flat spreading surface.

2. The handheld tactical knife of claim 1, wherein the length of the elongated knife blade is no more than 12 inches.

3. The handheld tactical knife blade of claim 1, wherein the elongated knife blade is made of a knife grade steel, alloy, plastic material, ceramic or composite.

4. The handheld tactical knife blade of claim 1, wherein the spine tapers from approximately 0.4 inches at said hilt to approximately 0.25 inches at said tip.

5. The handheld tactical knife blade of claim 1, wherein the elongated blade is coated with protectants, colorants, friction-reducing materials, or some combination thereof.

* * * * *